US006379501B1

(12) United States Patent
Zhang et al.

(10) Patent No.: US 6,379,501 B1
(45) Date of Patent: Apr. 30, 2002

(54) CELLULOSE PRODUCTS AND PROCESSES FOR PREPARING THE SAME

(75) Inventors: Fushan Zhang; Jimei Tong, both of Jacksonville, FL (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/459,891

(22) Filed: Dec. 14, 1999

(51) Int. Cl.[7] ..... D21H 17/70

(52) U.S. Cl. ..... 162/181.7; 162/181.2

(58) Field of Search ..... 162/181.1, 181.2, 162/181.3, 181.4, 181.5, 181.6, 181.7, 181.8, 181.9, 157.1, 157.2, 157.3, 157.4, 157.5, 157.6, 158, 159, 160, 161, 162, 163, 164.4, 182, 9; 423/326, 331, 332

(56) References Cited

U.S. PATENT DOCUMENTS

| | | | | | |
|---|---|---|---|---|---|
| 2,935,438 | A | | 5/1960 | Craig | 162/181.3 |
| 4,506,684 | A | * | 3/1985 | Keritsis | 131/369 |
| 4,643,801 | A | | 2/1987 | Johnson | 162/164.1 |
| 4,742,105 | A | | 5/1988 | Kelley | 524/447 |
| 4,753,710 | A | | 6/1988 | Langley et al. | 162/164.3 |
| 4,927,498 | A | | 5/1990 | Rushmere | 162/168.3 |
| 4,954,220 | A | | 9/1990 | Rushmere | 162/168.3 |
| 4,964,954 | A | | 10/1990 | Johansson | 162/164.6 |
| 4,980,025 | A | | 12/1990 | Andersson et al. | 162/168.3 |
| 4,995,986 | A | | 2/1991 | Mohn | 210/717 |
| 5,069,893 | A | * | 12/1991 | Haase et al. | 423/556 |
| 5,085,705 | A | * | 2/1992 | Withiam | 106/287.17 |
| 5,116,418 | A | | 5/1992 | Kaliski | 106/419 |
| 5,127,994 | A | | 7/1992 | Johansson | 162/168.3 |
| 5,185,206 | A | | 2/1993 | Rushmere | 428/403 |
| 5,194,120 | A | | 3/1993 | Peats et al. | 162/168.3 |
| 5,240,561 | A | * | 8/1993 | Kaliski | 162/138 |
| 5,275,699 | A | * | 1/1994 | Allan et al. | 162/181.2 |
| 5,300,147 | A | * | 4/1994 | Martensson et al. | 162/181.6 |
| 5,470,435 | A | | 11/1995 | Rushmere et al. | 162/181.6 |
| 5,482,693 | A | | 1/1996 | Rushmere et al. | 423/328.1 |
| 5,496,440 | A | | 3/1996 | Carré et al. | 162/168.3 |
| 5,514,249 | A | | 5/1996 | Cauley et al. | 162/164.1 |
| 5,543,014 | A | | 8/1996 | Rushmere et al. | 162/181.6 |
| 5,601,921 | A | * | 2/1997 | Eriksson | 428/389 |
| 5,626,721 | A | | 5/1997 | Rushmere et al. | 162/181.6 |
| 5,707,494 | A | * | 1/1998 | Rushmere et al. | 162/181.6 |
| 5,846,384 | A | * | 12/1998 | Schold et al. | 162/175 |
| 5,891,305 | A | | 4/1999 | Dondeyne et al. | 162/175 |
| 5,900,116 | A | * | 5/1999 | Nagan | 162/158 |
| 5,989,714 | A | | 11/1999 | Drummond | 428/402 |
| 6,265,030 | B1 | * | 7/2001 | Aronson | 427/397.8 |

FOREIGN PATENT DOCUMENTS

| | | | |
|---|---|---|---|
| EP | 0357574 | 3/1990 | D21H/23/76 |
| EP | 748897 A2 | 12/1996 | D21H/23/04 |
| JP | 63295794 | 12/1988 | D21H/3/78 |
| JP | 10-72793 | 3/1998 | D21H/17/37 |
| WO | 91/05106 | 4/1991 | D21H/21/22 |
| WO | 97/17289 | 5/1997 | C01B/33/20 |
| WO | 98/52877 | 11/1998 | C02F/1/52 |
| WO | 98/56715 | 12/1998 | C01B/33/143 |
| WO | 98/56716 | 12/1998 | C01B/33/143 |

OTHER PUBLICATIONS

An English Language abstract of JP 63–295794.
An English Language abstract of JP 10–72793.
J.G. Vail, "Soluble Silicates", American Chemical Society, Monograph Series, Reinhold Publishing Corporation, New York 36, USA, vol. 2, pp. 524–549, 1952.
A. Swerin et al., "Silica based microparticulate retention aid systems", Paperi Ja Puu: Paper and Timber, vol. 77, No. 77, No. 4, pp. 215–221, 1995.

* cited by examiner

*Primary Examiner*—Peter Chin
*Assistant Examiner*—Eric Hug
(74) *Attorney, Agent, or Firm*—Gary A. Samuels

(57) ABSTRACT

Processes for preparing cellulose products, such as paper products which include substantially simultaneously or sequentially adding at least one aluminum compound and at least one silicate to a cellulose slurry, to a cellulose slurry such as a paper slurry. In particular, the present invention is directed to processes for preparing the cellulose products, such as paper products which include substantially simultaneously or sequentially adding at least one aluminum compound and at least one monovalent silicate or water-soluble metal silicate complex to a cellulose slurry, such as a paper slurry. Compositions containing at least one aluminum compound and at least one water-soluble metal silicate, and cellulose products, such as paper products containing at least one water-soluble metal silicate complex.

31 Claims, No Drawings

CELLULOSE PRODUCTS AND PROCESSES FOR PREPARING THE SAME

CROSS-REFERENCE TO RELATED APPLICATION

The present application expressly incorporates by reference herein the entire disclosure of, U.S. application Ser. No. 09/459,890, entitled "Metal Silcates, Cellulose Products, and Processes Thereof" which is concurrently filed with the present application.

BACKGROUND OF THE INVENTION

1. Field of the Invention

The present invention is directed to processes for preparing cellulose products, such as paper products which include adding at least one aluminum compound and at least one water-soluble silicate to a cellulose slurry, such as a paper slurry. In particular, the present invention is directed to processes for preparing the cellulose products, such as paper products which include substantially simultaneously or sequentially adding at least one aluminum compound and at least one monovalent cation silicate or water-soluble metal silicate complex to a cellulose slurry, such as a paper slurry. In addition, the present invention is directed to compositions containing at least one aluminum compound and at least one water-soluble metal silicate. The present invention is also directed to cellulose products, such as paper products containing at least one water-soluble metal silicate complex.

2. Background of the Invention and Related Art

Cellulose products, such as paperboards, tissue papers, writing papers, and the like are traditionally made by producing an aqueous slurry of cellulosic wood fibers, which may contain inorganic mineral extenders or pigments. The aqueous slurry is deposited on a moving wire or fabric to facilitate the formation of a cellulose matrix. The cellulose matrix is then drained, dried, and pressed into a final cellulose product. However, during the draining step, desired solid fibers, solid fines, and other solids are often removed along with the water. In this regard, solid fines include very short pulp fibers or fiber fragments and ray cells. Solid fines also include pigments, fibers, and other nonfibrous additives that may pass through the fabric during sheet formation. Furthermore, during draining, undesired water is often retained in the cellulose matrix. The removal of the desired solids and retention of undesired water adversely affects sheet formation, and thus yields cellulose products of lower quality. Further, the loss of desired solids is wasteful and costly to cellulose product manufacturers.

As a result, the paper industry continuously strives to provide processes for papermaking that improve the paper quality, increase productivity, and reduce manufacturing costs. Chemicals are often added to the fibrous slurry before the papermaking wire or fabric to improve the drainage/dewatering and retention. These chemicals are called drainage and/or retention aids. Attempts have been made to add various drainage and/or retention aids in papermaking such as silicates, silica colloidals, microgels, and bentonites.

For example, U.S. Pat. No. 5,194,120 to Peats et al. discloses the addition of a cationic polymer and an amorphous metal silicate material to paper furnish to improve fines retention and drainage. The amorphous metal silicates of Peats et al. are white free-flowing powders, but form extremely small anionic colloidal particles when fully dispersed in water. These materials are usually synthesized by reacting a sodium silicate with a soluble salt of the appropriate metal ions, such as $Mg^{2+}$, $Ca^{2+}$, and/or $Al^{3+}$, to form a precipitate which is then filtered, washed, and dried.

WO/97/17289 and U.S. Pat. No. 5,989,714 to Drummond relate to a method of controlling drainage and/or retention in the formation of a paper matrix by using metal silicate precipitates. The metal silicate precipitates of Drummond are prepared by mixing soluble metal salt with soluble silicate.

JP 63295794 A to Naka-Mura relates to a neutral or weakly alkaline papermaking process which includes adding to the pulp slurry a cationic, water-soluble polymer and an aqueous solution of sodium silicate.

JP 10 72,793 to Haimo discloses a method for making paper by directly adding an aqueous solution of sodium orthosilicate to the paper slurry. The orthosilicate solution of Haimo has to be prepared in a separate step (e.g., treatment of aluminum sulfate to adjust the pH) prior to being added to the paper slurry.

U.S. Pat. Nos. 4,927,498, 4,954,220, 5,185,206, 5,470,435, 5,543,014, 5,626,721, and 5,707,494 to Rushmere and Rushmere et al. relate to the use of polysilicate microgels as retention and drainage aids in papermaking. The microgels of these patents are manufactured by an on-site process by reacting polysilicic acid with an alkali metal to form microgels. The microgels are then added to paper furnish.

U.S. Pat. No. 5,240,561 to Kaliski relates to the use of microgels in papermaking processes. The microgels of Kaliski are prepared by a two-step process. The first step involves the preparation of a transient, chemically reactive subcolloidal hydrosol by blending the paper furnish with two separate solutions. The second step is to blend an aqueous solution containing at least one cross-linking agent with the furnishes resulting from the first step to cross-link the in-situ-formed chemically reactive subcolloidal hydrosol and synthesize (in-situ) the complex functional microgel cements. The resulting cements flocculate the paper furnishes to form paper sheets. The process of Kaliski is a two-step process that is complicated and time consuming.

U.S. Pat. No. 4,753,710 to Langley et al. and U.S. Pat. No. 5,513,249 to Cauley are directed to the use of bentonite clay in paper making.

Despite many attempts to provide various types of drainage and retention aids, there still remains a need in the paper industry to provide a process for making cellulose products, such as paper products with excellent drainage and retention that are cost effective and at the same time simple to use. In addition, there is still a need for a cellulose product making process that yields significant improvements in retention and drainage while maintaining good formation of the paper sheet.

There is still a remaining need for a drainage for use in large production of paper products where productivity is not reduced due to slower water drainage through a thicker fibrous mat.

SUMMARY OF THE INVENTION

The present invention is directed to a process for preparing cellulose products which includes substantially simultaneously adding to cellulose slurry (1) at least one aluminum compound, and (2) at least one water-soluble silicate. The water-soluble silicate can be a monovalent cation silicate or a water-soluble metal silicate complex. The water-soluble metal silicate complex can be a reaction product of a monovalent cation silicate and divalent metal ions.

The molar ratio of the aluminum compound to the water-soluble silicate, based on $Al_2O_3/SiO_2$, is from about 0.1 to 10, preferably from about 0.2 to 5, and more preferably from about 0.5 to 2.

Examples of the aluminum compound include, but are not limited to, alum, $AlCl_3$ (aluminum chloride), PAC (polyaluminum chloride), PAS (polyaluminum sulfate), PASS (polyaluminum silicate sulfate), and/or poly aluminum phosphate, preferably alum, PAC, and/or PAS, and more preferably alum and/or PAC.

Suitable monovalent cation silicates of the present invention include, but are not limited to, sodium silicate, potassium silicate, lithium silicate, and/or ammonium silicate, preferably sodium silicate and/or potassium silicate, and more preferably sodium silicate. The sodium silicate preferably has an $SiO_2/Na_2O$ weight ratio in the range from about 2 to 4, more preferably from about 2.8 to 3.3, and most preferably from about 3.0 to 3.5.

The water-soluble metal silicate complex of the present invention can include at least one of monovalent cation silicate and divalent metal silicate. Examples of the divalent metal silicate include, but are not limited to magnesium silicate, calcium silicate, zinc silicate, copper silicate, iron silicate, manganese silicate, and/or barium silicate. More preferably, the divalent metal silicate includes magnesium silicate, calcium silicate, and/or zinc silicate. Most preferably, the divalent metal silicate includes magnesium silicate and/or calcium silicate.

The water-soluble divalent metal silicate complex is in accordance with the following formula:

$$(1-y)M_2O \cdot yM'O \cdot xSiO_2 \qquad \text{formula (1)}$$

wherein M is a monovalent ion; M' is a divalent metal ion; x is from about 2 to 4; y is from about 0.005 to 0.4; and y/x is from about 0.001 to 0.25.

M is of sodium, potassium, lithium, and ammonia. M' is one of calcium, magnesium, zinc, copper, iron (II), manganese (II), and barium. The divalent metal ion is derived from a source comprising water-soluble salt which comprises at least one of $CaCl_2$, $MgCl_2$, $MgSO_4$, $Ca(NO_3)_2$, $Mg(NO_3)_2$, and $ZnSO_4$.

The water-soluble divalent metal silicate complex preferably has a $SiO_2/M_2O$ molar ratio in the range from about 2 to 20, more preferably about 3 to 10, and most preferably from about 3 to 5, and an M'/Si molar ratio in the range from about 0.001 to 0.25.

The solution containing the water-soluble divalent metal silicate complex preferably has a concentration of $SiO_2$ in the range from about 0.01 to 5% by weight of the solution.

In the process of the present invention, the aluminum compound and the water-soluble divalent metal silicate complex are substantially simultaneously added to the cellulose slurry after a last high shear stage and before a headbox.

The process of the present invention can further include adding at least one additive to the cellulose slurry, the additives include, but are not limited to, at least one of flocculant, starch, coagulant, sizing agent, wet strength agent, dry strength agent, and other retention aids. The additives can be added to the cellulose slurry before or after the substantially simultaneous addition of the aluminum compound and water-soluble divalent metal silicate complex.

Examples of the flocculant of the present invention include, but are not limited to high molecular weight polymers, such as cationic polymers, anionic polymers, and substantially non-ionic polymers.

The cationic polymer includes, but are not limited to, homopolymers and copolymers containing at least one cationic monomer selected from at least dimethylaminoethylmethacrylate (DMAEM), dimethylaminoethylacrylate (DMAEA), methacryloyloxyethyltrimethylammonium chloride (METAC), dimethylaminopropylmethacrylate (DMAPMA), methacrylamidopropyl-trimethylammonium chloride (MAPTAC), dimethylaminopropylacrylamide (DMAPAA), acryloyloxyethyltrimethylammonium chloride (AETAC), dimethaminoethylstyrene, (p-vinylbenzyl)-trimethylammonium chloride, 2-vinylpyridine, 4-vinylpyridine, and vinylamine. For example, the cationic flocculant can be a copolymer of cationic polyacrylamide.

Examples of the anionic polymer include, but are not limited to, homopolymers and copolymers containing anionic monomers, such as acrylate, methacrylate, maleate, itaconate, sulfonate, and phosphonate. For example, the anionic flocculant can be a copolymer of anionic polyacrylamide.

The substantially non-ionic polymers include, but are not limited to, at least one of polyacrylamide, poly(ethylene oxide), polyvinylalcohol, and poly(vinylpyrrolidinone).

Examples of the starch include, but are not limited to, at least one of potato starch, corn starch, waxy maize starch, wheat starch, and corn starch.

Suitable coagulants include, but are not limited to, at least one of alum, aluminum chloride, polyaluminum chloride, polyaluminum sulfate, polyaluminum silicate sulfate, polyaluminum phosphate, polyamine, poly(diallyl dimethyl ammonium chloride), polyethyleneimine, and polyvinylamine.

The present invention is also directed to a process for preparing cellulose products which includes sequentially adding at least one aluminum compound and at least one water-soluble silicate to a cellulose slurry. The process can also include adding at least one additive to the cellulose slurry.

In addition, the present invention is directed to a composition for preparing cellulose products which contains at least one aluminum compound and at least one water-soluble silicate. The present invention is also related to a cellulose product containing cellulose fiber, at least one aluminum compound, and at least one residue of water-soluble metal silicate complex. The cellulose product is prepared by simultaneously or sequentially adding at least one aluminum compound and at least one water soluble silicate to a cellulose slurry. Preferably, the amount of the aluminum compound in the cellulose product can be about 100 to 5,000 ppm $Al_2O_3$, more preferably from about 200 to 2,000 ppm $Al_2O_3$, and most preferably from about 500 to 1,000 ppm $Al_2O_3$, and the amount of the water-soluble metal silicate complex in the cellulose product can be about 50 to 10,000 ppm $SiO_2$, more preferably from about 250 to 3,000 ppm $SiO_2$, and most preferably from about 500 to 2,000 ppm $SiO_2$.

The process for preparing cellulose products of the present invention is beneficial in papermaking. It increases the retention of fine furnish solids during the turbulent process of draining and forming the paper web. Without adequate retention of the fine solids, the solids are either lost to the process effluent or accumulate to high levels in the recirculating white water loop, causing potential deposit buildup and impaired paper machine drainage. Additionally, insufficient retention of the fine solids increases the papermaker' costs due to the loss of additives intended to be adsorbed on the fiber to provide the respective paper opacity, strength, or sizing properties.

The processes of the present invention yield significant improvements in retention and drainage while maintaining good formation of the paper products. The paper products of the present invention have excellent paper qualities.

Accordingly, an object of the present invention is to improve retention and drainage control in making cellulose products, such as paper.

Another object of the present invention is to provide processes for preparing cellulose products which processes involve substantially simultaneously adding (1) at least one aluminum compound; and (2) at least one monovalent cation silicate or at least one water-soluble metal silicate complex to a cellulose slurry, such as a paper slurry.

Still another object of the present invention is to provide cellulose products, such as paper products, containing water-soluble metal silicate complexes.

DETAILED DESCRIPTION OF THE INVENTION

The particulars shown herein are by way of example and for purposes of illustrative discussion of the various embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description making apparent to those skilled in the art how the several forms of the invention can be embodied in practice.

All percent measurements in this application, unless otherwise stated, are measured by weight based upon 100% of a given sample weight. Thus, for example, 30% represents 30 weight parts out of every 100 weight parts of the sample.

Unless otherwise stated, a reference to a compound or component, includes the compound or component by itself, as well as in combination with other compounds or components, such as mixtures of compounds.

Before further discussion, the following terms will be discussed to aid in the understanding of the present invention.

"Cellulose slurry" refers to a water-based slurry containing cellulose fibers, fines, and additives used in preparing cellulose products known in the art.

"Copolymer" refers to a polymer comprising two or more different kinds of monomers.

"Hardness" refers to the total concentration of divalent metal ions or their salts in water, e.g., calcium, magnesium, calcium carbonate, and calcium chloride. Hardness can be measured in parts per million of calcium equivalents. In this regard, 1 ppm Ca equivalent is equal to 2.78 ppm $CaCl_2$ equivalent which is equal to 2.50 ppm $CaCO_3$ equivalent. In addition, 1 ppm Mg equivalent equals to 1.65 ppm Ca equivalent, 4.57 ppm $CaCl_2$ equivalent, and 4.12 ppm $CaCO_3$ equivalent.

"Paper slurry" or "paper furnish" refers to a water-based slurry containing fibers and/or fines, such as of wood and vegetable, and/or cotton, and which may contain other additives for papermaking such as fillers, e.g., clay and precipitated calcium carbonate.

"Sequential addition" refers to at least two different substances being added to different locations on a machine used to prepare cellulose products. These locations are far away enough so that the one substance added is mixed with the cellulose slurry before another substance is added.

"Substantially simultaneously adding" or "simultaneously adding" refers to adding two substances to a cellulose slurry with substantially no time difference and essentially at the same position. The two substances being added can be in the form of a mixture as well as separately, e.g., by adding one substance during the addition of the other.

"Water-soluble" and "stability" refer to the ability of the metal silicate complexes of the present invention to remain in solution. When the water-soluble metal silicate complexes of the present invention are formed, the process may be controlled so that no precipitate is formed. However, under some circumstances, a slight amount of precipitate may form. If the metal silicate complexes form precipitate, they are no longer complexes, but are metal silicate precipitate. In the present invention, it is desired that the metal silicate complexes of the present invention remain in solution and do not form a precipitate. It is noted that some of the water-soluble metal silicate complex may precipitate with time, however, it is preferred that no precipitate or a minimal amount of precipitate is formed. As long as the metal silicate complexes are water-soluble, the solutions should be essentially colorless and clear. In this regard, the water-soluble metal silicate complexes of the present invention are not visible to the naked eye. In particular, considering that turbidity depends on concentration, an aqueous composition of the water-soluble metal silicate complex of the present invention having a concentration of 0.3 wt. % of $SiO_2$, in the absence of other materials that affect turbidity, would preferably have a turbidity of less than about 70 NTU, more preferably less than about 50 NTU, and most preferably less than about 20 NTU. The water-soluble metal silicate complexes of the present invention cannot be separated from the aqueous phase by most physical or mechanical separation techniques, such as centrifugation, sedimentation, or filtration.

As an overview, the present invention relates to simple and cost-effective processes for preparing cellulose products, such as paper products. In particular, the process of the present invention includes substantially simultaneously adding to a cellulose slurry (1) at least one aluminum compound; and (2) at least one water-soluble silicate. Preferably, the water-soluble silicate can be a monovalent cation silicate or a water-soluble metal silicate complex. The water-soluble metal silicate complex can be a reaction product of the monovalent cation silicate and divalent metal ions.

In addition, the present invention relates to compositions containing at least one aluminum compound and at least one water-soluble silicate. The present invention also relates to cellulose products, such as paper products which contain at least one aluminum compound and at least one water-soluble metal silicate complex.

In one embodiment, the present invention is directed to a process for preparing cellulose products. Specifically, the process of the present invention includes substantially simultaneously adding at least one aluminum compound and at least one monovalent cation silicate to a cellulose slurry.

The molar ratio of the aluminum compound to the monovalent cation silicate, based on $Al_2O_3/SiO_2$, is from about 0.1 to 10, preferably from about 0.2 to 5, and more preferably from about 0.5 to 2.

Examples of the aluminum compound include, but are not limited to, alum $AlCl_3$ (aluminum chloride), PAC (polyaluminum chloride), PAS (polyaluminum sulfate), and/or PASS (polyaluminum silicate sulfate), poly aluminum phosphate, preferably alum, PAC, and/or PAS, and more preferably alum and/or PAC.

Examples of the monovalent cation silicate of the present invention include, but are not limited to, sodium silicate, potassium silicate, lithium silicate, and/or ammonium silicate, preferably sodium silicate and/or potassium silicate, and more preferably sodium silicate.

The cellulose slurry of the present invention can preferably include at least one divalent metal ion. Examples of divalent metals useful in the present invention include, but are not limited to, magnesium, calcium, zinc, copper, iron (II), manganese(II), and/or barium. Preferably, the divalent metal includes magnesium, calcium, and/or zinc. Most preferably, the divalent metal includes magnesium and/or calcium.

The divalent metal ion is derived from a source of water-soluble salt, such as $CaCl_2$, $MgCl_2$, $MgSO_4$, $Ca(NO_3)_2$, $Mg(NO_3)_2$, and/or $ZnSO_4$, preferably $CaCl_2$, $MgCl_2$, and/or $ZnSO_4$, and more preferably $CaCl_2$ and/or $MgCl_2$.

The cellulose slurries of the present invention may contain fillers known in the art, such as clay, titanium dioxide, ground calcium carbonate, or precipitated calcium carbonates. The pH and temperature of the cellulose slurry are not considered to be important factors in the present invention. As long as the pH and temperature of the cellulose slurry are under normal conditions, such as pH in a range of about 4 to 10 and temperature of about 5 to 80° C., the water-soluble metal silicate complexes of the present invention are effective.

When a monovalent cation silicate is added to the cellulose slurry to form a water-soluble metal silicate complex in situ, the cellulose slurry of the present invention preferably has a hardness from about 1 to 600 ppm (part per million) Ca equivalent, more preferably from about 10 to 200 ppm Ca equivalent, and most preferably from about 20 to 100 ppm Ca equivalent. If the cellulose slurry has a hardness from about 1 to 600 ppm Ca equivalent, the monovalent cation silicate can react with the divalent metal ions in the cellulose slurry and form the water-soluble metal silicate complex of the present invention.

Alternatively, the process for preparing paper products of the present invention as noted above, includes substantially simultaneously adding at least one aluminum compound and at least one water-soluble metal silicate complex to a cellulose slurry.

The molar ratio of the aluminum compound to the water-soluble metal silicate complex, based on $Al_2O_3/SiO_2$, is from about 0.1 to 10, preferably from about 0.2 to 5, and more preferably from about 0.5 to 2.

The water-soluble metal silicate complexes of the present invention preferably contain at least one kind of divalent silicate and at least one monovalent cation silicate.

As noted above, examples of divalent silicates useful in the water-soluble metal silicate complexes of the present invention include, but are not limited to, alkaline earth metals and transition metals. For instance, the divalent metal can include magnesium, calcium, zinc, copper, iron(II), manganese(II), and/or barium. Preferably, the divalent metal includes magnesium, calcium, and/or zinc. Most preferably, the divalent metal includes magnesium and/or calcium.

The preferred divalent metal silicate includes magnesium silicate, calcium silicate, zinc silicate, copper silicate, iron silicate, manganese silicate, and/or barium silicate. More preferably, the divalent metal silicate includes magnesium silicate, calcium silicate, and/or zinc silicate. Most preferably, the divalent metal silicate includes magnesium silicate and/or calcium silicate.

Examples of monovalent cation silicates useful in the water-soluble metal silicate complexes of the present invention include monovalent cations, such as sodium, potassium, lithium and/or ammonium. Preferably, the monovalent cations include sodium and/or potassium. Most preferably, the monovalent cations include sodium.

The preferred monovalent cation silicate includes sodium silicate, potassium silicate, lithium silicate, and/or ammonium silicate, more preferably includes sodium silicate and/or potassium silicate, and most preferably, sodium silicate. The sodium silicate preferably has an $SiO_2/Na_2O$ weight ratio in the range from about 2 to 4, more preferably from about 2.8 to 3.3, and most preferably from about 3.0 to 3.5.

In a preferred embodiment of the present invention, the metal silicate complex is a magnesium silicate complex and/or a calcium silicate complex prepared by adding sodium silicate to an aqueous composition containing magnesium and/or calcium ions. Preferably, an aqueous composition of the water-soluble metal silicate complex of the present invention comprises $SiO_2$ in an amount of about 0.01 to 5% by weight of the aqueous composition, has a $SiO_2$/monovalent cation oxide, such as $Na_2O$, molar ratio from about 2 to 20, and a divalent metal, e.g., (Mg+Ca)/Si molar ratio from about 0.001 to 0.25.

Not wishing to be bound by theory, the water-soluble metal silicate complexes of the present invention can include water-soluble metal silicate complexes having the following formula:

$$(1-y)M_2O \cdot yM'O \cdot xSiO_2 \qquad \text{formula (1)}$$

where: M is a monovalent ion as discussed above,

M' is a divalent metal, such as the divalent metals discussed above, x is preferably from about 2 to 4, y is preferably from about 0.005 to 0.4, and y/x is preferably from about 0.001 to 0.25.

The ability of the metal silicate complexes of the present invention to remain in solution, i.e., the stability of the metal silicate complexes, is important to achieving the results of the present invention. For instance, stability is important with respect to improving retention and drainage control in cellulose products making. In particular, the metal silicate precipitates which may be formed have low or no activity with respect to retention and drainage control. In some cases, the metal silicate complexes have a slight precipitate and still demonstrate reasonable retention and drainage activity, because an insignificant portion of the metal silicate complexes is converted to precipitate and the majority of the components remain water-soluble. As discussed above, an aqueous composition of the water-solubility complex of the present invention having $SiO_2$ at a concentration of 0.3 wt. % can preferably have a turbidity of less than about 70 NTU, more preferably a turbidity of less than about 50 NTU, and most preferably a turbidity of less than about 20 NTU.

The ability of the metal silicate complexes of the present invention to remain in solution, i.e., stability, generally depends upon several factors. Some of these factors include (1) molar ratio of $SiO_2/M_2O$, (2) molar ratio of M'/Si, (3) concentration of $SiO_2$, (4) size of the microparticles of the complex, (5) hardness of the aqueous composition in which the complexes are formed, (6) agitation applied during formation of the metal silicate complexes, (7) pH of the aqueous composition, (8) temperature of the aqueous composition, and (9) solutes in the aqueous composition. Of these factors, the most important are molar ratio of $SiO_2/M_2O$ and molar ratio of M'/Si. The ability of the metal silicate complexes to remain in solution depends upon an interaction of these factors, as discussed in more detail below.

Before discussing variables that can affect the stability of the water-soluble metal silicate complexes involved in the process of making the water-soluble metal silicate complexes, a discussion of stability factors which are specific to the complexes themselves is presented below.

The water-soluble metal silicate complexes of the present invention preferably have an $SiO_2/M_2O$ molar ratio, i.e., x:(1−y) for compounds in accordance with formula (1), in the range from about 2 to 20, preferably 3 to 10, and more preferably from about 3.0 to 5.0. When this value is too high, the metal silicate complex could form a precipitate and lose activity. When this value is too low, a relatively small amount of metal silicate complex is formed.

The water-soluble metal silicate complexes of the present invention preferably have an M'/Si molar ratio, i.e., y:x for compounds in accordance with formula (1), in the range from about 0.001 to 0.25, preferably from about 0.01 to 0.2, and more preferably 0.025 to 0.15. When this value is too high, the metal silicate complex could form a precipitate and lose activity. When this value is too low, a relatively small amount of metal silicate complex is formed.

It is expected that the water-soluble metal silicate complexes of the present invention can have a microparticle size preferably less than about 200 nm, more preferably from about 2 to 100 nm, and more preferably from about 5 to 80 nm, as measured by dynamic laser light scattering at 25° C. in aqueous solution. If the particle size is too large, the metal silicate complexes will form precipitate. If the particle size is too small, the metal silicate complexes will not have enough flocculating power.

In addition, before discussing the variable of making the water-soluble metal silicate of the present invention which affects the stability of the water-soluble complexes of the present invention, an overview of the process of making the water-soluble metal silicate complexes of the present invention is presented below.

The water-soluble metal silicate complexes of the present invention can be prepared by adding at least one monovalent cation silicate to an aqueous solution containing divalent metal ions. When at least one monovalent cation silicate is mixed with an aqueous solution containing divalent metal ions, the water-soluble metal silicate complexes are spontaneously formed during the mixing of the monovalent cation silicates and aqueous solution.

Alternatively, the water-soluble metal silicate complexes of the present invention can be prepared by (1) adding at least one monovalent silicate to an aqueous solution; and (2) simultaneously or subsequently adding a source of divalent metal ions to the aqueous composition. The monovalent cation silicates interact with the divalent metal ions in the aqueous composition and form water-soluble metal silicate complexes.

Suitable monovalent cation silicates used to prepare water-soluble metal silicate complexes of the present invention can be in the form of a powder or a liquid. As noted above, examples of the monovalent cation silicate include, but are not limited to sodium silicate, potassium silicate, lithium silicate, and/or ammonium silicate.

Also as discussed above, examples of divalent metal ions useful in making the water-soluble metal silicate complexes of the present invention include, but are not limited to, alkaline earth metals and transition metals, such as magnesium, calcium, zinc, copper, iron(II), manganese(II), and/or barium.

When at least one monovalent cation silicate is added to an aqueous solution containing divalent metal ions, the aqueous composition of the present invention preferably has a hardness from about 1 to 600 ppm Ca equivalent, more preferably from about 10 to 200 ppm Ca equivalent, and most preferably from about 20 to 100 ppm Ca equivalent.

The temperature of the aqueous solution is from about 5 to 95° C., preferably from about 10 to 80° C., and more preferably from about 20 to 60° C.

Examples of aqueous solution containing divalent metal ions include, but are not limited to, tray water, hard water, treated water, and cellulose slurry. "Tray water" which is also known as "silo water" refers to water collected from a cellulose product machine during cellulose product making, e.g., water collected from a paper machine during and after papermaking.

In the present invention, the tray water preferably has a pH from about 6 to 10, more preferably from about 7 to 9, and most preferably from about 7.5 to 8.5. The tray water in the paper machine is typically warm and typically has a temperature from about 10 to 60° C., more typically from about 30 to 60° C., and more typically from about 45 to 55° C.

"Hard water" refers to water containing a substantial amount of metal ions, such as $Mg^{2+}$ and/or $Ca^{2+}$ ions. "Treated water" refers to hard or soft water that has been treated to increase or decrease hardness. If the water hardness is too high, as discussed below, some of the metal ions can be blocked or become deactivated by any known technique in the art, such as by adding at least one chelating agent, e.g., ethylenediaminetetraacetic acid (EDTA), hydroxyethylethlenediaminetriacetic acid (HEDTA), tartaric acid, citric acid, gluconic acid, and polyacrylic acid. If the water hardness is too low, as discussed below, divalent metal ions can be added. For instance, magnesium and/or calcium salt can be added to increase metal ions, and thus increase water hardness. In particular, $CaCl_2$, $MgCl_2$, $MgSO_4$, $Ca(NO_3)_2$, $Mg(NO_3)_2$, $CaSO_4$, and/or $ZnSO_4$, preferably $CaCl_2$, $MgCl_2$, and/or $ZnSO_4$, more preferably $CaCl_2$ and/or $MgCl_2$, can be added to the aqueous composition to increase the concentration of metal ions.

"Paper slurry solution" refers to paper furnish or paper slurry in papermaking. The paper slurry solution preferably has a pH from about 4 to 10, more preferably from about 6 to 9, and most preferably from about 7 to 8.5. The paper slurry solution in the paper machine is typically warm and typically has a temperature from about 5 to 80° C., more typically from about 10 to 60° C., and more typically from about 15 to 55° C.

With the above in mind, there are several variables of the process of making the water-soluble complexes that can affect the ability of the metal silicate complexes to remain in solution. These process variables include (1) concentration of $SiO_2$ in the aqueous composition, (2) hardness of the aqueous composition, (3) agitation applied during formation of the water-soluble metal silicate complexes, (4) pH of the aqueous composition, (5) temperature of the aqueous composition, and (6) additional solutes in the aqueous composition. Of these variables, the concentration of $SiO_2$ in the aqueous composition and the hardness of the aqueous composition are the most important.

When a monovalent cation silicate is combined with a divalent metal ion to form an aqueous composition comprising the water-soluble metal silicate complexes of the present invention, the resulting aqueous composition preferably has a concentration of $SiO_2$ of about 0.01 to 5 wt. %, more preferably from about 0.1 to 2 wt. %, and most preferably from about 0.25 to 1.5 wt. %, by weight of the aqueous composition. When this value is too high, the metal silicate complex could form a precipitate and lose activity.

When this value is too low, the composition is not economical because a large amount of solution is required.

When divalent metal ions are added to an aqueous composition comprising monovalent cation silicate, the aqueous composition preferably has a concentration of $SiO_2$ of about 0.01 to 30 wt. %, more preferably from about 0.1 to 15 wt. %, and most preferably from about 0.25 to 10 wt. %, by weight of the aqueous composition. When this value is too high, the metal silicate complex may form a precipitate, and thus may lose activity (e.g., drainage and retention properties). When this value is too low, the composition is not economical because a large amount of the solution would be required.

When monovalent cation silicate is added to an aqueous composition having divalent metal ions, the aqueous composition of the present invention preferably has a hardness from about 1 to 600 ppm Ca equivalent, more preferably from about 10 to 200 ppm Ca equivalent, and most preferably about 20 to 100 ppm Ca equivalent. If hardness is too high, the metal silicate complex may precipitate. If the hardness is too low, the water-soluble metal silicate complex may not form.

Agitation applied during formation of the metal silicate complexes also affects the ability of the metal silicate complexes to remain in solution. If no agitation is applied, under some circumstances, the water-soluble complex of the present invention may locally precipitate due to overconcentration. The effect of agitation, however, is difficult to quantify. The amount of agitation depends upon such factors as the amount and viscosity of the solution, size of the container, size and type of stirrer bar or propeller, rotation speed of stirrer or mixer, and so on. For example, in laboratory preparation, when a 100 ml of a metal silicate complex solution in a 200 ml beaker is mixed using a 1" stirrer bar on a MIRAK™ Magnetic Stirrer (Model#L SO&3235-60, Bernstead Thermolyne Corporation, 2555 Kerper Blvd., Dubuque, Iowa 52004), 300 rpm or higher mixing speed should be proper. In general, as long as possible, agitation should be maximized. However, if agitation is too high, it may not be economical due to overconsumption of energy, or it may cause vibration of the equipment or split of the solution.

Although the pH of the aqueous composition is expected to be an important factor in the ability of the metal silicate complexes to remain in solution, the precise effect of the pH has not been studied. However, the present invention has been found to work with tray water as an example. Tray water typically has a pH from about 6 to 10, more typically from about 7 to 9, and most typically from about 7.5 to 8.5.

The temperature of the aqueous composition is preferably about 5 to 95° C., more preferably about 10 to 80° C., and most preferably about 20 to 60° C. For instance, tray water in the paper machine is typically warm and typically has a temperature from about 10 to 65° C., more typically from about 30 to 60° C., and most typically from about 45 to 55° C. Thus, the metal silicate complexes can be formed at ambient temperature. At lower M'/Si ratio, increasing the temperature will accelerate the formation of the metal silicate complexes. At higher M'/Si ratio, the temperature has little effect.

Another factor which is expected to affect the ability of the metal silicate complexes to remain in solution is the presence of solutes in the aqueous composition. For instance, it is expected that the presence of counterions would affect the stability of the metal silicate complexes.

As discussed, the water-soluble metal silicate complexes of the present invention are prepared by adding monovalent cation silicates to an aqueous solution containing divalent metal ions. The monovalent cation silicates of the present invention are water-soluble and can be in the form of a powder or a liquid. The water-soluble metal silicate complexes are spontaneously formed during the dilution of monovalent cation silicates into an aqueous solution containing sufficient hardness. Thus, the water-soluble metal silicate complexes of the present invention are in a liquid form. The process of preparing the water-soluble metal silicate complexes of the present invention is simple and does not require any special manufacturing process. The water-soluble metal silicate complexes of the present invention can be formed as a concentrate in an off-site factory or may be prepared on-site, e.g., at a paper mill.

In accordance with the present invention, the substantially simultaneous addition of at least one aluminum compound and at least one water-soluble metal silicate complex or at least one monovalent cation silicate to a cellulose slurry yields significant improvements in retention and drainage while maintaining good formation of the paper sheet. The process of the present invention is beneficial in papermaking, especially when a large amount of drainage is required (e.g., at least about 76 lb/3300 sq. ft) where productivity can be reduced due to slower water drainage through a thicker fibrous mat.

The dewatering or drainage of the fibrous slurry in papermaking wire is often the limiting step in achieving higher product rates. Increased dewatering can also result in a dryer paper sheet in the press and dryer sections, and thus yield reduced steam consumption. This is also the stage in a papermaking process that determines many final sheet properties.

Similarly, the process of the present invention reduces loss of fillers and fines, and thus reduces production costs. In addition, the process of the present invention also provides excellent paper formation due to proper drainage and retention.

Alternatively, the cellulose products of the present invention can be prepared by sequentially adding at least one aluminum compound and at least one water-soluble silicate to a cellulose slurry. The water-soluble silicate preferably includes at least one metal silicate complex or at least one monovalent cation silicate. The molar ratio of the aluminum compound to the water-soluble silicate, based on $Al_2O_3/SiO_2$, is from about 0.1 to 10, preferably from about 0.2 to 5, and most preferably from about 0.5 to 2.

According to the present invention, the substantially simultaneous or sequential addition of (1) at least one aluminum compound, and (2) at least one at least one monovalent cation silicate or water-soluble metal silicate complex is preferably added to the paper furnish after the point of the last high shear stage, but before the headbox, to avoid having the flocs formed subjected to excessive shear forces.

The aluminum compound is preferably added at a dosage from about 1 to 40 lb/ton based on the dry weight of the paper furnish (paper slurry), preferably from about 2 to 20 lb/ton of $SiO_2$ based on the dry weight of the furnish, and most preferably from about 2.5 to 10 lb/ton of $SiO_2$ based on the dry weight of the furnish.

The water-soluble metal silicate complex or the monovalent silicate is preferably added at a dosage from about 0.1 to 20 lb/ton of $SiO_2$ based on the dry weight of the paper furnish (paper slurry), preferably from about 0.5 to 6 lb/ton of $SiO_2$ based on the dry weight of the furnish, most preferably from about 1 to 4 lb/ton of $SiO_2$ based on the dry weight of the paper furnish.

In addition, at least one additive is preferably added to the cellulose slurry in conjunction with the aluminum compound and water-soluble silicate of the present invention. Suitable additives of the present invention include any additive known in the art, such as flocculants, starches, and coagulant, sizing agent, wet strength agent, dry strength agent, and other retention aid, preferably flocculants, starches, and coagulant.

The additive can be added to the cellulose slurry before or after the substantially simultaneous or sequential addition of (1) the aluminum compound, and (2) the monovalent silicate or water-soluble metal silicate complex.

The order of the additive and the substantially simultaneous or sequential addition of (1) the aluminum compound and (2) the monovalent silicate or water-soluble metal silicate complex added to the paper furnish is not critical. However, the substantially simultaneous or sequential addition of (1) the aluminum compound and (2) the monovalent silicate or water-soluble metal silicate complex is preferably added to the paper stock after the addition of the flocculant. Preferably, the additive is added to a point before the last high shear stage, such as at the pressure screen and cleaners, while the aluminum compound and the water-soluble metal silicate complex or the monovalent silicate are simultaneously or sequentially added after the point of the last high shear stage, but prior to the headbox.

When two or more additives are added to the cellulose slurry of the present invention, the preferred additives are flocculant and starch. The starch can be added to the cellulose slurry before or after the flocculant. Preferably, the starch is added before the flocculant.

When a coagulant is added to the cellulose slurry in conjunction with at least one flocculant and/or starch, the coagulant can be added prior to or after the flocculant and/or starch.

According to the present invention, the flocculant can be either a cationic, or anionic, or substantially nonionic polymer. Preferably, the flocculant is a cationic polymer.

Examples of the cationic flocculants include, but are not limited to, homopolymers or copolymers containing at least one cationic monomer selected from at least one of the following: dimethylaminoethylmethacrylate (DMAEM), dimethylaminoethylacrylate (DMAEA), methacryloyloxyethyltrimethylammonium chloride (METAC), dimethylaminopropylmethacrylate (DMAPMA), methacrylamidopropyl-trimethylammonium chloride (MAPTAC), dimethylaminopropylacrylamide (DMAPAA), acryloyloxyethyltrimethylammonium chloride (AETAC), dimethaminoethylstyrene, (p-vinylbenzyl)-trimethylammonium chloride, 2-vinylpyridine, 4-vinylpyridine, vinylamine, and the like. For example, the cationic flocculant can be a copolymer of cationic polyacrylamide.

The molecular weight of the cationic flocculant is preferably from at least about 500,000, with a range of preferably about 2,000,000 to 15,000,000, more preferably about 4,000,000 to 12,000,000, and most preferably about 5,000,000 to 10,000,000.

The degree of cationic substitution for the cationic flocculant is preferably at least about 1 mol. %, with a range of preferably about 5 to 50 mol. %, even more preferably from about 10 to 30 mol. %.

The potential charge density for the cationic flocculant is preferably 0.1 to 4 meq/g, more preferably from about 0.5 to 3 meq/g, and most preferably about 1 meq/g to 2.5 meq/g.

In the cellulose product making process of the present invention, the dosage of the cationic flocculant is preferably about 0.1 to 4 lb/ton, more preferably about 0.2 to 2 lb/ton, and most preferably about 0.25 to 1 lb/ton, based on active ingredient of the flocculant and dry weight of the cellulose slurry.

Suitable anionic flocculants of the present invention can be homopolymers or copolymers containing anionic monomers selected from the following: acrylate, methacrylate, maleate, itaconate, sulfonate, phosphonate, and the like. For example, the anionic flocculant can be a copolymer of anionic polyacrylamide.

The molecular weight of the anionic flocculants of the present invention is preferably at least about 500,000, with a range of preferably about 5,000,000 to 20,000,000, and more preferably from about 8,000,000 to 15,000,000.

The degree of anionic substitution for the anionic flocculant is preferably at least about 1 mol. %, with a range of preferably about 10 to 60 mol. %, more preferably about 15 to 50 mol. %.

The potential charge density for the anionic flocculant is preferably about 1 to 20 meq/g, more preferably about 2 to 8 meq/g, and most preferably about 2.5 to 6 meq/g.

In the cellulose product making process of the present invention, the dosage of the anionic flocculant is preferably about 0.1 to 4 lb/ton, more preferably about 0.2 to 2 lb/ton, and most preferably about 0.25 to 1 lb/ton, based on active ingredient of the flocculant and dry weight of the cellulose slurry.

Examples of the substantially nonionic flocculants of the present invention include, but are not limited to, polyacrylamide, poly (ethylene oxide), polyvinylalcohol, and poly(vinylpyrrolidinone), preferably polyacrylamide, poly (ethylene oxide), and polyvinylalcohol, and more preferably polyacrylamide and poly (ethylene oxide).

The molecular weight of the substantially nonionic flocculant is preferably at least about 500,000, with a range of preferably about 1,000,000 to 10,000,000, more preferably from about 2,000,000 to 8,000,000.

In the cellulose product making process of the present invention, the dosage of the substantially nonionic flocculant is preferably about 0.2 to 4 lb/ton, more preferably about 0.5 to 2 lb/ton, based on active ingredient of the flocculant and dry weight of the cellulose slurry.

As discussed above, cationic starch, including amphoteric starch, may also be added to the cellulose slurry of the present invention. Preferably, cationic starch is used in cellulose product making as a wet or dry strength additive. The cationic starch of the present invention preferably has a cationic charge substitution of at least about 0.01, with a range of preferably about 0.01 to 1, more preferably about 0.1 to 0.5. The cationic starch can be derived from a variety of plants, such as potato, corn, waxy maize, wheat, and rice.

The molecular weight of the starch is preferably about 1,000,000 to 5,000,000, more preferably about 1,500,000 to 4,000,000, and most preferably about 2,000,000 to 3,000,000.

The starch of the present invention can be added to the cellulose slurry at a point before or after the flocculant, preferably before the water-soluble silicate of the present invention. The preferred dosage for the starch is from about 1 to 50 lb/ton, more preferably from about 5 to 20 lb/ton, based on dry weight of the cellulose slurry.

Another additive that can be added to the cellulose slurry of the present invention is coagulant. Examples of coagulants of the present invention include, but are not limited to, inorganic coagulants, such as alum, or similar materials, such as aluminum chloride, polyaluminum chloride PAC), polyaluminum sulfate (PAS), and polyaluminum sulfate silicate (PASS), or organic coagulants such as polyamines, poly(diallyl dimethyl ammonium chloride), polyethyleneimine, polyvinylamine, and the like, preferably the inorganic coagulants, and more preferably alum, or similar materials.

The molecular weight of the organic coagulant is preferably about 1,000 to 1,000,000, more preferably about 2,000 to 750,000, more preferably from about 5,000 to 500,000.

The coagulant of the present invention can be added to the cellulose slurry at a point before or after the flocculant, preferably before the water-soluble silicate of the present invention. The preferred dosage for the inorganic coagulant is from about 1 to 30 lb/ton, more preferably from about 5 to 20 lb/ton, based on dry weight of the cellulose slurry. The preferred dosage for the organic coagulant is 0.1 to 5 lb/ton, more preferably about 0.5 to 2 lb/ton.

The paper products made from the process of the present invention have excellent paper qualities. The paper products resulting from the processes of the present invention contain a cellulose fiber, at least one aluminum compound, and at least one water-soluble metal silicate complex.

As discussed, the cellulose products of the present invention are prepared by substantially simultaneously or sequentially adding at least one aluminum compound and at least one water-soluble silicate to a cellulose slurry. Preferably, the water-soluble silicate includes at least one monovalent cation silicate and divalent metal silicate complex.

Again, as noted above, the simultaneous addition of the aluminum compound and water-soluble silicate can be added separately or together in the form of a mixture. Thus, the present invention is also directed to a composition for preparing cellulose products containing at least one aluminum compound and at least one water-soluble silicate.

The cellulose product of the present invention contains cellulose fiber, at least one aluminum compound, and at least one residue of water-soluble metal silicate complex. Preferably, the amount of the aluminum compound in the cellulose product can be about 100 to 5,000 ppm $Al_2O_3$, more preferably from about 200 to 2,000 ppm $Al_2O_3$, and most preferably from about 500 to 1,000 ppm $Al_2O_3$, and the amount of the water-soluble metal silicate complex in the cellulose product can be about 50 to 10,000 ppm $SiO_2$, more preferably from about 250 to 3,000 ppm $SiO_2$, and most preferably from about 500 to 2,000 ppm $SiO_2$.

When the paper products are made by substantially simultaneously or sequentially adding at least one aluminum compound and at least one monovalent cation silicate to a cellulose slurry, a water-soluble metal silicate complex can be formed if the cellulose slurry contains at least one divalent ion and have a hardness of about 1 to 600 ppm calcium equivalent.

Also as discussed above, the cellulose slurry can include cellulose fibers, fillers and papermaking ingredients known in the art, such as clay, titanium dioxide, ground calcium carbonate, or precipitated calcium carbonate. After the substantially simultaneous or sequential addition of (1) at least one aluminum compound, and (2) at least one water-soluble metal silicate complex or monovalent cation silicate, and optionally the addition of at least one additive to a cellulose slurry, the cellulose slurry is then deposited on a papermaking wire, drained, dried, and pressed into a final paper product by any technique known in the art.

The processes of the present invention yield significant improvements in retention and drainage while maintaining good formation of the cellulose products. The processes of the present invention provide high quality cellulose products.

The process for preparing paper products of the present invention is beneficial in papermaking. The processes of the present invention increase the retention of fine furnish solids during the turbulent process of draining and forming the paper web. Without adequate retention of the fine solids, they are either lost to the process effluent or accumulate to high levels in the recirculating white water loop, causing potential deposit buildup and impaired paper machine drainage. Additionally, insufficient retention of the fine solids increases the papermaker' costs due to the loss of additives intended to be adsorbed on the fiber to provide the respective paper opacity, strength, or sizing properties.

Without further elaboration, it is believed that one skilled in the art can, using the preceding description, utilize the present invention to its fullest extent.

The following preferred specific embodiments are, therefore, to be construed as merely illustrative, and not limitative of the remainder of the disclosure in any way whatsoever.

EXAMPLES

The examples below are directed to processes for preparing paper products which include adding an aluminum compound and a metal silicate to a paper furnish of the present invention. Additives such as flocculant and starch are also added to the processes of the present invention. The processes of the present invention increase drainage and retention rates in papermaking.

The aluminum compound used in the following examples is an alum. The alum used is a liquid aluminum sulfate containing 48.5 wt. % dry solid of $Al_2(SO_4)_3 \cdot 14H_2O$ (obtained from General Chemical Corporation, 90 East Halsey Road, Parsippany, N.J. 07054).

The sodium silicate used in the following examples is Sodium Silicate O, which is manufactured by The PQ Corporation (P.O. Box 840, Valley Forge, Pa. 19482-0840). It contains 29.5 wt. % $SiO_2$ and has a $SiO_2/Na_2O$ weight ratio of 3.22.

The paper furnish used in the examples have 0.3 wt. % consistency, and contains 80 wt. % fibers and 20 wt. % precipitated calcium carbonate (PCC) filler by weight of the total dry furnish. The fibers used in the paper furnish is a 70/30 blend of hardwood/softwood. The hardwood fiber is a bleached chemical pulp, St. Croix Northern Hardwood, manufactured by Ekman and Company (STE 4400, 200 S. Biscayne Blvd., Miami, Fla. 33130). The softwood fiber is a bleached chemical pulp, Georgianier Softwood, manufactured by Rayonier (4470 Savanna HWY, Jessup, Ga.). The PCC is Albacar 5970 manufactured by Specialty Minerals (230 Columbia Street, Adams, Mass. 01220).

The temperature of the paper furnish is from 21 to 25° C. The pH of the paper furnish is from 7.5 to 9. The amount of the paper furnish used in the examples below is 1,000 liters.

The additives used in the examples are cationic starch, coagulant, and flocculant. The cationic starch is Sta-Lok 600™ (manufactured by A. E. Staley Manufacturing Company).

The coagulant is alum. This alum is also a liquid aluminum sulfate containing 48.5 wt. % dry solid of $Al_2(SO_4)_3 \cdot 14H_2O$ (manufactured by General Chemical Corporation, 90 East Halsey Road, Parsippany, N.J. 07054).

The flocculants are either cationic or anionic in nature. The cationic flocculant is a cationic modified polyacrylamide (CPAM) having a molecular weight of about 6,000,000 and a cationic charge of 10 mol. %. CPAM is PC 8695 manufactured by Hercules Incorporated. (Wilmington, Del.). The anionic flocculant is an anionic modified polyacrylamide (APAM) having a molecular weight of about 20,000,000 and an anionic charge of about 30 mol. %. APAM is PA8130 manufactured by Hercules Incorporated (Wilmington, Del.).

The units used to determine the amount of the additives in the following examples are in #/T (lb/ton) based on the dry weight of the paper furnish. The amount of starch and alum used are determined based on dry product. The amount of cationic and anionic flocculant used are determined based on active solids. The amount of the metal silicates used are based on dry weight of $SiO_2$ or as dry weight of sodium silicate.

Unless specified, the addition of each additive, alum, and sodium silicate to the paper furnish are in the following order: cationic starch, alum (as coagulant), flocculant, and testing materials. The mixing time for cationic starch and alum is 10 seconds.

After at least one additive and/or alum and/or sodium silicate is added to the paper furnish, the paper furnish is then transferred to a Canadian Standard Freeness (CSF) device so that drainage activity can be measured. This CFS drainage test is performed by mixing 1000 ml of the paper furnish with various additives including the metal silicates to be tested in a squared beaker at ambient temperature (unless specified) and at 1200 rpm mixing speed.

Presented below are Examples 1–8 directed to drainage tests for paper furnish. The results of Examples 1–8 are shown in Table 1 below.

Example 1

In this example, 10#/T of cationic starch, 5#/T of alum, and 1#/T of CPAM are sequentially added to a paper furnish. The paper furnish is transferred to a CSF device so that drainage rates are measured.

Example 2

Alum is diluted to 0.375 wt. % of dry solid by adding 0.77 g of liquid alum to 99.23 g of deionized water. The 5#/T of the diluted alum is added to a paper furnish.

Subsequently, 10#/T of cationic starch, 1#/T of CPAM, and 5#/T of alum are sequentially added to the paper furnish. The paper furnish is transferred to a CSF device so that drainage rates are measured.

Example 3

Sodium Silicate O is diluted to 0.15 wt. % of $SiO_2$ by adding 0.51 g of liquid Sodium Silicate O to 99.49 g of deionized water. 1#/T of the diluted Sodium Silicate O is added to a pretreated paper furnish. The paper furnished is pretreated by adding 10#/T of cationic starch, 5#/T of alum and 1#/T of CPAM are sequentially added to the paper furnish. The furnish is transferred to a CSF device so that drainage rates are measured.

Example 4

Sodium Silicate O is diluted to 0.3 wt. % of $SiO_2$ by adding 1.02 g of liquid Sodium Silicate O to 98.98 g of deionized water. 2#/T of the diluted Sodium Silicate O is added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

Example 5

Sodium Silicate O is diluted to 0.15 wt. % of $Si_2$ by adding 0.51 g of liquid Sodium Silicate O to 99.49 g of deionized water.

Alum is diluted to 0.375 wt. % of dry solid by adding 0.77 g of liquid alum to 99.23 g of deionized water.

1#/T of the diluted Sodium Silicate O and 5#/T of the diluted alum are simultaneously added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

Example 6

Sodium Silicate O is diluted to 0.3 wt. % of $SiO_2$ by adding 1.02 g of liquid Sodium Silicate O to 98.98 g of deionized water.

Alum is diluted to 0.375 wt. % of dry solid by adding 0.77 g of liquid alum to 99.23 g of deionized water.

2#/T of the diluted Sodium Silicate O and 5#/T of the diluted alum are simultaneously added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

Example 7

Sodium Silicate O is diluted to 0.15 wt. % of $SiO_2$ by adding 0.51 g of liquid Sodium Silicate O to 99.49 g of deionized water.

Alum is diluted to 0.375 wt. % of dry solid by adding 0.77 g of liquid alum to 99.23 g of deionized water.

1#/T of the diluted Sodium Silicate O and 10#/T of the diluted alum are simultaneously added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

Example 8

Sodium Silicate O is diluted to 0.3 wt. % of $SiO_2$ by adding 1.02 g of liquid Sodium Silicate O to 98.98 g of deionized water.

Alum is diluted to 0.375 wt. % of dry solid by adding 0.77 g of liquid alum to 99.23 g of deionized water.

2#/T of the diluted Sodium Silicate O and 10#/T of the diluted alum are simultaneously added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

TABLE 1

| Example No. | Cat. Starch (#/T) | Alum (#/T) | CPAM (#/T) | Sodium Silicate/Alum (#/T)/(#/T) | CSF (ml) |
|---|---|---|---|---|---|
| 1 | 10 | 5 | 1 | 0/0 | 453 |
| 2 | 10 | 5 | 1 | 0/5 | 510 |

TABLE 1-continued

| Example No. | Cat. Starch (#/T) | Alum (#/T) | CPAM (#/T) | Sodium Silicate/Alum (#/T)/(#/T) | CSF (ml) |
|---|---|---|---|---|---|
| 3 | 10 | 5 | 1 | 1/0 | 510 |
| 4 | 10 | 5 | 1 | 2/0 | 550 |
| 5 | 10 | 5 | 1 | 1/5 | 573 |
| 6 | 10 | 5 | 1 | 2/5 | 633 |
| 7 | 10 | 5 | 1 | 1/10 | 620 |
| 8 | 10 | 5 | 1 | 2/10 | 665 |

Table 1 illustrates that simultaneous addition of sodium silicate and alum to the paper furnish (Examples 5–10) yields higher a drainage rate than sequential addition of either Sodium Silicate O or alum to the paper furnish (Example 2–4).

Specifically, in the control example (Example 1), when only additives are sequentially added to the furnish, the drainage rate is 453 ml. In the comparative examples (Examples 2–4), when either Sodium Silicate O or alum and additives are sequentially added to the furnish, the drainage rate is from 510 to 550 ml, which is 57 to 97 ml higher than the control. Thus, there is an increase in drainage rate when either the Sodium Silicate O or alum is use.

In Examples 5–8, when Sodium Silicate O and alum are simultaneously added (followed by sequential addition of additives), the drainage rate is from 573 to 665 ml, which is 120 to 212 ml higher than the control example. Thus, there is a significant increase in drainage rate when the Sodium Silicate O and alum are simultaneously added to the furnish.

Presented below are Examples 9–11 directed to drainage tests for paper furnish. The results of Examples 9–11 are shown in Table 2 below.

Example 9

Sodium Silicate O is diluted to 0.15 wt. % of $SiO_2$ by adding 0.51 g of liquid Sodium Silicate O to 99.49 g of deionized water.

1#/T of the diluted Sodium Silicate O is added to a pretreated paper furnish. The paper furnished is pretreated by adding 10#/T of cationic starch, 10#/T of alum, and 1#/T of CPAM are sequentially added to the paper furnish. The paper furnish is transferred to a CSF device so that drainage rates are measured.

Example 10

Sodium Silicate O is diluted to 0.15 wt. % of $SiO_2$ by adding 0.51 g of liquid Sodium Silicate O to 99.49 g of deionized water.

Alum is diluted to 0.375 wt. % of dry solid by adding 0.77 g of liquid alum to 99.23 g of deionized water.

1#/T of the diluted Sodium Silicate O and 5#/T of the diluted alum are simultaneously added to a pretreated paper furnish. The paper furnished is pretreated by adding 10#/T of cationic starch, 5#/T of alum, and 1#/T of CPAM are sequentially added to the paper furnish. The paper furnish is transferred to a CSF device so that drainage rates are measured.

Example 11

Sodium Silicate O is diluted to 0.15 wt. % of $SiO_2$ by adding 0.51 g of liquid Sodium Silicate O to 99.49 g of deionized water.

Alum is diluted to 0.375 wt. % of dry solid by adding 0.77 g of liquid alum to 99.23 g of deionized water.

1#/T of the diluted Sodium Silicate O and 10#/T of the diluted alum are simultaneously added to a pretreated paper furnish. The paper furnished is pretreated by adding 10#/T of cationic starch and 1#/T of CPAM are sequentially added to the paper furnish. The paper furnish is transferred to a CSF device so that drainage rates are measured.

TABLE 2

| Example No. | Cat. Starch (#/T) | Alum (#/T) | CPAM (#/T) | Sodium Silicate/Alum (#/T)/(#/T) | CSF (ml) |
|---|---|---|---|---|---|
| 9 | 10 | 10 | 1 | 1/0 | 540 |
| 10 | 10 | 5 | 1 | 1/5 | 573 |
| 11 | 10 | 0 | 1 | 1/10 | 600 |

Table 2 illustrates that simultaneous addition of the sodium silicate and alum to the paper furnish (Examples 10 and 11) yields a higher drainage rate than sequential addition of either Sodium Silicate O or alum to the paper furnish (Example 9).

Specifically, in the comparative example (Example 9), when only Sodium Silicate O and additives are sequentially added to the furnish, the drainage rate is 540 ml.

In Examples 10 and 11, when Sodium Silicate O and alum are simultaneously added (followed by sequential addition of additives), the drainage rate is from 573 to 600 ml, which is 33 to 60 ml higher than the comparative example. Thus, there is a significant increase in drainage rate when the Sodium Silicate O and alum are simultaneously added to the furnish. Table 2 clearly illustrates that the simultaneous addition of alum and sodium silicate yields the higher drainage rate than the cases in which total alum or part of alum is added to paper furnish separately from sodium silicate.

Presented below are Examples 12–15 directed to drainage tests for paper furnish. The results of Examples 12–15 are shown in Table 3 below.

Example 12

10#/T of cationic starch and 5#/T of alum are sequentially added to a paper furnish. The paper furnish is then transferred to a CSF device so that drainage rates are measured.

Example 13

A paper furnish is pretreated by sequentially adding to a paper furnish 10#/T of cationic starch and 5#/T of alum.

Alum is diluted to 0.375 wt. % of dry solid by adding 0.77 g of liquid alum to 99.23 g of deionized water.

5#/T of the diluted alum is subsequently added to the pretreated paper furnish.

The paper furnish is then transferred to a CSF device so that drainage rates are measured.

Example 14

A paper furnish is pretreated by sequentially adding to a paper furnish 10#/T of cationic starch and 5#/T of alum.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

2#/T of the Ca/Mg silicate complex is added to the pretreated paper furnish.

The paper furnish is then transferred to a CSF device so that drainage rates are measured.

Example 15

A paper furnish is pretreated by sequentially adding to a paper furnish 10#/T of cationic starch and 5#/T of alum.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

Alum is diluted to 0.375 wt. % of dry solid by adding 0.77 g of liquid alum to 99.23 g of deionized water.

2#/T of the Ca/Mg silicate complex and 5#/T of the diluted alum are simultaneously added to a paper furnish.

The paper furnish is then transferred to a CSF device so that drainage rates are measured.

TABLE 3

| Example No. | Cat. Starch (#/T) | Alum (#/T) | APAM (#/T) | Ca/Mg silicate complexes/Alum (#/T)/(#/T) | CSF (ml) |
|---|---|---|---|---|---|
| 12 | 10 | 5 | 0 | 0/0 | 428 |
| 13 | 10 | 5 | 0 | 0/5 | 488 |
| 14 | 10 | 5 | 0 | 2/0 | 515 |
| 15 | 10 | 5 | 0 | 2/5 | 570 |

Table 3 illustrates that simultaneous addition of the sodium silicate and alum to the paper furnish (Example 15) yields a higher drainage rate than sequential addition of either Ca/Mg silicate complexes or alum to the paper furnish (Example 13 and 14).

Specifically, in the control example (Example 12), when only additives are sequentially added to the furnish, the drainage rate is 428 ml. In the comparative examples (Examples 13 and 14), when either Ca/Mg silicate complexes or alum and additives are sequentially added to the furnish, the drainage rate is 488 and 515 ml respectively, which is 60 to 87 ml higher than the control. Thus, there is an increase in drainage rate when either the Ca/Mg silicate complexes or alum.

In Example 15, when Ca/Mg silicate complexes and alum are simultaneously added (followed by sequential addition of additives), the drainage rate is 570 ml, which is 142 ml higher than the control example. Thus, there is a significant increase in drainage rate when the Ca/Mg silicate complexes and alum are simultaneously added to the furnish.

Presented below are Examples 16–19 directed to drainage tests for paper furnish. The results of Examples 16–19 are shown in Table 4 below.

Example 16

10#/T of cationic starch, 5#/T of alum, and 0.25#/T of APAM are sequentially added to a paper furnish.

The paper furnish is then transferred to a CSF device so that drainage rates are measured.

Example 17

A paper furnish is pretreated by sequentially adding to a paper furnish 10#/T of cationic starch, 5#/T of alum, and 0.25 of #/T of APAM.

Alum is diluted to 0.375 wt. % of dry solid by adding 0.77 g of liquid alum to 99.23 g of deionized water.

5#/T of the diluted alum is subsequently added to the pretreated paper furnish.

The paper furnish is then transferred to a CSF device so that drainage rates are measured.

Example 18

A paper furnish is pretreated by sequentially adding to a paper furnish 10#/T of cationic starch, 5#/T of alum, and 0.25#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

2#/T of the Ca/Mg silicate complex is added to the pretreated paper furnish.

The paper furnish is then transferred to a CSF device so that drainage rates are measured.

Example 19

A paper furnish is pretreated by sequentially adding to a paper furnish 10#/T of cationic starch, 5#/T of alum, and 0.25#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

Alum is diluted to 0.375 wt. % of dry solid by adding 0.77 g of liquid alum to 99.23 g of deionized water.

2#/T of the Ca/Mg silicate complex and 5#/T of the diluted alum are simultaneously added to a paper furnish.

The paper furnish is then transferred to a CSF device so that drainage rates are measured.

TABLE 4

| Example No. | Cat. Starch (#/T) | Alum (#/T) | APAM (#/T) | Ca/Mg silicate complexes/Alum (#/T)/(#/T) | CSF (ml) |
|---|---|---|---|---|---|
| 16 | 10 | 5 | 0.25 | 0/0 | 490 |
| 17 | 10 | 5 | 0.25 | 0/5 | 525 |
| 18 | 10 | 5 | 0.25 | 2/0 | 543 |
| 19 | 10 | 5 | 0.25 | 2/5 | 575 |

Table 4 illustrates that simultaneous addition of the sodium silicate and alum to the paper furnish (Example 19) yields a higher drainage rate than sequential addition of either Ca/Mg silicate complexes or alum to the paper furnish (Example 17 and 18).

Specifically, in the control example (Example 16), when only additives are sequentially added to the furnish, the drainage rate is 490 ml. In the comparative examples (Examples 17 and 18), when either Ca/Mg silicate complexes or alum and additives are sequentially added to the furnish, the drainage rate is 525 and 543 ml respectively, which is 35 to 53 ml higher than the control. Thus, there is an increase in drainage rate when either the Ca/Mg silicate complexes or alum.

In Example 19, when Ca/Mg silicate complexes and alum are simultaneously added to a pretreated paper furnished, the drainage rate is 575 ml, which is 85 ml higher than the control example. Thus, there is a significant increase in drainage rate when the Ca/Mg silicate complexes and alum are simultaneously added to the furnish.

Presented below are Examples 20–23 directed to drainage tests for paper furnish. The results of Examples 20–23 are shown in Table 5 below.

Example 20

10#/T of cationic starch, 5#/T of alum, and 0.5#/T of APAM are sequentially added to a paper furnish.

The paper furnish is then transferred to a CSF device so that drainage rates are measured.

Example 21

A paper furnish is pretreated by sequentially adding to a paper furnish 10#/T of cationic starch, 5#/T of alum, and 0.5#/T of APAM.

Alum is diluted to 0.375 wt. % of dry solid by adding 0.77 g of liquid alum to 99.23 g of deionized water.

5#/T of the diluted alum is subsequently added to the pretreated paper furnish.

The paper furnish is then transferred to a CSF device so that drainage rates are measured.

Example 22

A paper furnish is pretreated by sequentially adding to a paper furnish 10#/T of cationic starch, 5#/T of alum, and 0.5#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

2#/T of the Ca/Mg silicate complex is added to the pretreated paper furnish.

The paper furnish is then transferred to a CSF device so that drainage rates are measured.

Example 23

A paper furnish is pretreated by sequentially adding to a paper furnish 10#/T of cationic starch, 5#/T of alum, and 0.5#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

Alum is diluted to 0.375 wt. % of dry solid by adding 0.77 g of liquid alum to 99.23 g of deionized water.

2#/T of the Ca/Mg silicate complex and 5#/T of the diluted alum are simultaneously added to a paper furnish.

The paper furnish is then transferred to a CSF device so that drainage rates are measured.

TABLE 5

| Example No. | Cat. Starch (#/T) | Alum (#/T) | APAM (#/T) | Ca/Mg silicate complexes/Alum (#/T)/(#/T) | CSF (ml) |
|---|---|---|---|---|---|
| 20 | 10 | 5 | 0.5 | 0/0 | 548 |
| 21 | 10 | 5 | 0.5 | 0/5 | 540 |
| 22 | 10 | 5 | 0.5 | 2/0 | 585 |
| 23 | 10 | 5 | 0.5 | 2/5 | 605 |

Table 5 illustrates that simultaneous addition of the sodium silicate and alum to the paper furnish (Example 23) yields a higher drainage rate than sequential addition of either Ca/Mg silicate complexes or alum to the paper furnish (Example 21 and 22).

Specifically, in the control example (Example 20), when only additives are sequentially added to the furnish, the drainage rate is 548 ml. In the comparative examples (Examples 21 and 22), when either Ca/Mg silicate complexes or alum and additives are sequentially added to the furnish, the drainage rate is 540 and 585 ml respectively, which is 8 to 37 ml higher than the control. Thus, there is an increase in drainage rate when either the Ca/Mg silicate complexes or alum.

In Example 23, when Ca/Mg silicate complexes and alum are simultaneously added to a pretreated paper furnish, the drainage rate is 605 ml, which is 57 ml higher than the control example. Thus, there is a significant increase in drainage rate when the Ca/Mg silicate complexes and alum are simultaneously added to the furnish.

Presented below are Examples 24–27 directed to drainage tests for paper furnish. The results of Examples 24–27 are shown in Table 6 below.

Example 24

10#/T of cationic starch, 5#/T of alum, and 1#/T of APAM are sequentially added to a paper furnish.

The paper furnish is mixed then transferred to a CSF device so that drainage rates are measured.

Example 25

A paper furnish is pretreated by sequentially adding to a paper furnish 10#/T of cationic starch, 5#/T of alum, and 1#/T of APAM.

Alum is diluted to 0.375 wt. % of dry solid by adding 0.77 g of liquid alum to 99.23 g of deionized water.

5#/T of the diluted alum is subsequently added to the pretreated paper furnish.

The paper furnish is then transferred to a CSF device so that drainage rates are measured.

Example 26

A paper furnish is pretreated by sequentially adding to a paper furnish 10#/T of cationic starch, 5#/T of alum, and 1#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

2#/T of the Ca/Mg silicate complex is added to the pretreated paper furnish.

The paper furnish is then transferred to a CSF device so that drainage rates are measured.

Example 27

A paper furnish is pretreated by sequentially adding to a paper furnish 10#/T of cationic starch, 5#/T of alum, and 1#/T of APAM.

A Ca/Mg silicate complex containing 0.3 wt. % $SiO_2$ and having a (Ca+Mg)/Si molar ratio of 0.035 is prepared by adding 1.02 g of liquid Sodium Silicate O to a 98.98 g Ca/Mg solution. The solution is then mixed for about 30 minutes and allowed to stand for about 3 hours. The Ca/Mg solution has a water hardness of 68 ppm Ca equivalent.

Alum is diluted to 0.375 wt. % of dry solid by adding 0.77 g of liquid alum to 99.23 g of deionized water.

2#/T of the Ca/Mg silicate complex and 5#/T of the diluted alum are simultaneously added to a paper furnish.

The paper furnish is then transferred to a CSF device so that drainage rates are measured.

TABLE 6

| Example No. | Cat. Starch (#/T) | Alum (#/T) | APAM (#/T) | Ca/Mg silicate complexes/Alum (#/T)/(#/T) | CSF (ml) |
|---|---|---|---|---|---|
| 24 | 10 | 5 | 1 | 0/0 | 603 |
| 25 | 10 | 5 | 1 | 0/5 | 615 |
| 26 | 10 | 5 | 1 | 2/0 | 600 |
| 27 | 10 | 5 | 1 | 2/5 | 645 |

Table 6 illustrates that simultaneous addition of the sodium silicate and alum to the paper furnish (Example 27) yields a higher drainage rate than sequential additions of either Ca/Mg silicate complexes or alum to the paper furnish (Example 25 and 26).

Specifically, in the control example (Example 24), when only additives are sequentially added to the furnish, the drainage rate is 603 ml. In the comparative examples (Examples 25 and 26), when either Ca/Mg silicate complexes or alum and additives are sequentially added to the furnish, the drainage rate is 600 and 615 ml, respectively.

In Example 24, when Ca/Mg silicate complexes and alum are simultaneously added to a pretreated paper furnish, the drainage rate is 570 ml, which is 142 ml higher than the control example. Thus, there is a significant increase in drainage rate when the Ca/Mg silicate complexes and alum are simultaneously added to the furnish.

The preceding examples can be repeated with similar success by substituting the generically and specifically described constituents and/or operating conditions of this invention for those used in the preceding examples. From the foregoing descriptions, one skilled in the art can easily ascertain the essential characteristics of this invention, and without departing from the spirit and scope thereof, can make various changes and modifications of the invention to adapt to various usages and conditions.

What is claimed is:

1. A process for preparing cellulose products which comprises substantially simultaneously adding to cellulose slurry (1) at least one aluminum compound, and (2) at least one water-soluble metal silicate complex that is comprised of at least one reaction product of monovalent cation silicate and divalent metal ions.

2. The process of claim 1, wherein the molar ratio of the at least one aluminum compound to the at least one water-soluble metal silicate complex, based on $Al_2O_3/SiO_2$, is from about 0.1 to 10.

3. The process of claim 2, wherein the molar ratio of the at least one aluminum compound to the at least one water-soluble metal silicate complex, based on $Al_2O_3/SiO_2$, is from about 0.5 to 2.

4. The process of claim 2, wherein the at least one aluminum compound comprises at least one of alum, aluminum chloride, polyaluminum chloride, polyaluminum sulfate, polyaluminum silicate sulfate, and polyaluminum phosphate.

5. The process of claim 4, wherein the at least one aluminum compound comprises alum or polyaluminum chloride.

6. The process of claim 1, wherein the water-soluble metal silicate complex is in accordance with the following formula:

$$(1-y)M_2O \cdot yM'OxSiO_2 \qquad \text{formula (1)}$$

wherein M is a monovalent ion; M' is a divalent metal ion; x is from about 2 to 4; y is from about 0.005 to 0.4; and y/x is from about 0.001 to 0.25.

7. The process of claim 6, wherein M comprises one of sodium, potassium, lithium, and ammonia.

8. The process of claim 7, where M comprises sodium.

9. The process of claim 6, wherein M' comprises one of calcium, magnesium, zinc, copper (II), iron (II), manganese, and barium.

10. The process of claim 9, wherein M' comprises one of calcium and magnesium.

11. The process of claim 6, wherein M' is derived from a source comprising water-soluble salt which comprises at least one of $CaCl_2$, $MgCl_2$, $MgSO_4$, $Ca(NO_3)_2$, $Mg(NO_3)_2$, and $ZnSO_4$.

12. The process of claim 6, wherein the water-soluble divalent metal silicate complex has a $SiO_2/M_2O$ molar ratio in the range from about 2 to 20.

13. The process of claim 7, wherein the water-soluble divalent metal silicate complex has a $SiO_2/M_2O$ molar ratio in the range from about 3 to 5.

14. The process of claim 6, wherein the water-soluble divalent metal silicate complex has an M'/Si molar ratio in the range from about 0.001 to 0.25.

15. The process of claim 6, wherein a solution comprising the water-soluble divalent metal silicate complex has a concentration of $SiO_2$ in the range from about 0.01 to 5% by weight of the solution.

16. The process of claim 6, wherein the water-soluble divalent metal silicate complex comprises at least one of magnesium silicate, calcium silicate, zinc silicate, copper silicate, iron silicate, manganese silicate, and barium silicate.

17. The process of claim 16, wherein the water-soluble divalent metal silicate complex comprises at least one of magnesium silicate and calcium silicate.

18. The process of claim 16, wherein the at least one aluminum compound and the water-soluble divalent metal silicate complex are substantially simultaneously added to the cellulose slurry after a last high shear stage and before a headbox.

19. The process of claim 18, further comprising adding at least one additive to the cellulose slurry, the additive comprises at least one of flocculant, starch, and coagulant.

20. The process of claim 19, wherein at least one additive is added to the cellulose slurry before or after the substantially simultaneous addition of the at least one aluminum compound and the water-soluble divalent metal silicate complex.

21. The process of claim 20, wherein the flucculant comprises a high molecular weight polymer which comprises at least one of cationic polymer, anionic polymer, and substantially non-ionic polymer, wherein the cationic polymer comprises at least one of homopolymer and copolymer containing at least one cationic monomer selected from at least one of dimethylaminoethylmethacrylate (DMAEM), dimethylaminoethylacrylate (DMAEA), methacryloyloxyethyltrimethylammonium chloride (METAC), dimethylaminopropylmethacrylate (DMAPMA), methacrylamidopropyl-trimethylammonium chloride (MAPTAC), dimethylaminopropylacrylamide (DMAPAA), acryloyloxyethyltrimethylammonium chloride (AETAC), dimethaminoethylstyrene, (p-vinylbenzyl)-trimethylammonium chloride, 2-vinylpyridine, 4-vinylpyridine, and vinylamine;

wherein the anionic polymer comprises one of homopolymer and copolymer containing at least one anionic monomer selected from at least one of acrylate, methacrylate, maleate, itaconate, sulfonate, and phosphonate; and wherein the substantially non-ionic polymer comprises at least one of polyacrylamide, poly(ethylene oxide), polyvinylalcohol, and poly(vinylpyrrolidinone).

22. The process of claim 20, wherein the starch comprises at least one of potato starch, corn starch, waxy maize starch, wheat starch, and corn starch.

23. The process of claim 20, wherein the coagulant comprises at least one of alum, aluminum chloride, polyaluminum chloride, polyaluminum sulfate, polyaluminum silicate sulfate, polyaluminum phosphate, polyamine, poly (diallyl dimethyl ammonium chloride), polyethyleneimine, and polyvinylamine.

24. The process of claim 1 wherein the at least one aluminum compound comprises at least one of alum, aluminum chloride, polyaluminum chloride, polyaluminum sulfate, polyaluminum silicate sulfate, and polyaluminum phosphate, and wherein the at least one water-soluble monovalent cation silicate comprises at least one of sodium silicate, potassium silicate, lithium silicate, and ammonium silicate; and wherein the at least one aluminum compound and the at least one water-soluble monovalent cation silicate are substantially simultaneously added to the cellulose slurry after a last high shear stage and before a headbox.

25. An aqueous composition which comprises at least one aluminum compound and at least one water-soluble silicate which is in accordance with the following formula:

$$(1-y)M_2O \cdot yM'O \cdot xSiO_2 \qquad \text{formula (1)}$$

wherein M is a monovalent ion; M' is a divalent metal ion; x is from about 2 to 4; y is from about 0.005 to 0.4; and y/x is from about 0.001 to 0.25.

26. The composition of claim 25, wherein a molar ratio of the at least one aluminum compound to the at least one water-soluble silicate, based on $Al_2O_3/SiO_2$, is from about 0.1 to 10.

27. The composition of claim 26, wherein the molar ratio of the at least one aluminum compound to the at least one water-soluble silicate, based on $Al_2O_3/SiO_2$, is from about 0.5 to 2.

28. The composition of claim 26, wherein the at least one aluminum compound comprises at least one of alum, aluminum chloride, polyaluminum chloride, polyaluminum sulfate, polyaluminum silicate sulfate, and polyaluminum phosphate.

29. A cellulose product comprising cellulose fiber, at least one aluminum compound, and at least one divalent metal silicate complex; wherein the molar ratio and the at least one aluminum compound to the at least one divalent metal silicate complex, based on $Al_2O_3/SiO_2$, is from at least 0.1 to 10; and wherein the at least one aluminum compound comprises at least one of alum, aluminum chloride, polyaluminum chloride, polyaluminum sulfate, polyaluminum silcate sulfate, and polyaluminum phosphate, and wherein the at least one divalent silicate contains at least one divalent metal silicate comprising at least one of magnesium silicate, calcium silicate, zinc silicate, copper silicate, iron silicate, managenese silicate, and barium silicate.

30. The cellulose product of claim 24, wherein the aluminum compound comprises alum or polyaluminum chloride, and wherein the water soluble divalent metal silicate complex contain at least one of magnesium silicate and calcium silicate.

31. A cellulose product made by a process comprising combining cellulose slurry, at least one aluminum compound, and at least one water-soluble metal silicate, wherein a molar ratio of the at least one aluminum compound to the at least one water-soluble metal silicate, based on $Al_2O_3/SiO_2$, is from about 0.1 to 10.

* * * * *